US006300258B1

(12) United States Patent
Stano et al.

(10) Patent No.: US 6,300,258 B1
(45) Date of Patent: Oct. 9, 2001

(54) NONWOVENS TREATED WITH SURFACTANTS HAVING HIGH POLYDISPERSITIES

(75) Inventors: Dana Elizabeth Stano, Lilburn; Roger Bradshaw Quincy, III, Cumming, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/384,737

(22) Filed: Aug. 27, 1999

(51) Int. Cl.[7] ..... B32B 27/04
(52) U.S. Cl. ..... 442/118
(58) Field of Search ..... 442/59, 118

(56) References Cited

U.S. PATENT DOCUMENTS

| | | | |
|---|---|---|---|
| Re. 35,621 | 10/1997 | Schmalz | 156/308.8 |
| 3,338,992 | 8/1967 | Kinney | 264/24 |
| 3,341,394 | 9/1967 | Kinney | 161/72 |
| 3,485,706 | 12/1969 | Evans | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 3,850,819 | 11/1974 | Shay | 252/8.75 |
| 3,855,046 | 12/1974 | Hansen et al. | 161/150 |
| 3,896,807 | 7/1975 | Buchalter | 128/261 |
| 3,901,236 | 8/1975 | Assarsson et al. | 128/284 |
| 4,076,633 | 2/1978 | Edwards et al. | 252/8.75 |
| 4,076,663 | 2/1978 | Masuda et al. | 260/17.4 GC |
| 4,100,324 | 7/1978 | Anderson et al. | 428/288 |
| 4,110,227 | 8/1978 | Newkirk et al. | 252/8.9 |
| 4,142,017 | 2/1979 | Blackburn et al. | 428/284 |
| 4,189,395 | 2/1980 | Bland | 252/91 |
| 4,192,754 | 3/1980 | Marshall et al. | 252/8.8 |
| 4,199,464 | 4/1980 | Cambre | 252/91 |
| 4,199,465 | 4/1980 | Rodriguez | 252/91 |
| 4,223,065 | 9/1980 | Amemiya et al. | 428/272 |
| 4,250,047 | 2/1981 | Katabe et al. | 252/49.5 |
| 4,283,292 | 8/1981 | Marshall et al. | 252/8.8 |
| 4,286,082 | 8/1981 | Tsubakimoto et al. | 526/240 |
| 4,317,736 | 3/1982 | Marshall | 252/8.75 |
| 4,340,382 | 7/1982 | Morlino et al. | 8/137 |
| 4,340,563 | 7/1982 | Appel et al. | 264/518 |
| 4,410,447 | 10/1983 | Decker et al. | 252/351 |
| 4,416,787 | 11/1983 | Marshall et al. | 252/8.8 |
| 4,536,324 | 8/1985 | Fujiwara et al. | 252/311 |
| 4,622,038 | 11/1986 | Login et al. | 8/115.6 |
| 4,631,226 | 12/1986 | Jellinek | 428/270 |
| 4,725,489 | 2/1988 | Jones et al. | 428/289 |

(List continued on next page.)

FOREIGN PATENT DOCUMENTS

| | | | |
|---|---|---|---|
| 41 36 540 | 5/1992 | (DE) | A61F/13/15 |
| 0 598 204 | 5/1994 | (EP) | D06M/13/224 |
| 598 204 | 5/1994 | (EP) | D06M/13/224 |
| 2 285 232 | 7/1995 | (GB) | C09D/183/12 |
| 01 104700 | 4/1989 | (JP) | A61K/7/00 |
| WO 97/23182 | 7/1997 | (WO) | A61F/13/15 |
| 98/10134 | 3/1998 | (WO) | D06M/15/03 |

OTHER PUBLICATIONS

Manson, John A. and Sperling, Leslie H., *Polymer Blends and Composites*, Plenum Press, a division of Plenum Publishing Corp., New York, New York, pp. 273–277 (1976).

*Primary Examiner*—Terrel Morris
*Assistant Examiner*—Christopher C. Pratt
(74) *Attorney, Agent, or Firm*—Pauley Petersen Kinne & Fejer

(57) ABSTRACT

A nonwoven web treated with a hydrophilic surfactant having high polydispersity results in a fabric having fast wetting which is durable to multiple fluid insults and to fabric aging during storage. The treated nonwoven fabric can be used in a wide variety of applications including, without limitation, absorbent applications.

27 Claims, 4 Drawing Sheets

U.S. PATENT DOCUMENTS 4,735,739 4/1988 Floyd et al. ..... 252/91
4,738,847 4/1988 Rothe et al. ..... 424/443
4,740,398 4/1988 Bouchette ..... 428/28
4,753,844 6/1988 Jones et al. ..... 428/288
4,764,418 8/1988 Kuenn et al. ..... 428/284
4,818,421 4/1989 Boris et al. ..... 252/8.8
4,818,464 4/1989 Lau ..... 264/510
4,828,912 5/1989 Hossain et al. ..... 428/289
4,857,271 8/1989 Belly et al. ..... 422/55
4,889,925 12/1989 Schmid et al. ..... 536/18.6
4,920,168 4/1990 Nohr et al. ..... 524/188
4,925,722 5/1990 Jeffers et al. ..... 428/131
4,925,988 5/1990 Licht et al. ..... 568/625
4,938,832 7/1990 Schmalz ..... 156/308.8
4,938,888 7/1990 KIEfer et al. ..... 252/91
4,978,462 12/1990 Sheppard .
5,045,387 9/1991 Schmalz ..... 428/284
5,055,216 10/1991 Johnson ..... 252/91
5,057,361 10/1991 Sayovitz et al. ..... 428/290
5,070,171 12/1991 O'Lenick, Jr. ..... 528/33
5,108,820 4/1992 Kaneko et al. ..... 428/198
5,108,827 4/1992 Gessner ..... 428/219
5,158,575 10/1992 Czech ..... 8/116.1
5,160,450 11/1992 Okahara et al. ..... 252/174.21
5,209,965 * 5/1993 Caldwell ..... 428/260
5,227,242 7/1993 Walter et al. ..... 428/446
5,232,742 8/1993 Chakravarti ..... 427/387
5,234,720 8/1993 Neal et al. ..... 427/393.1
5,254,269 10/1993 Taylor et al. ..... 252/86
5,258,221 11/1993 Meirowitz et al. ..... 428/288
5,283,023 2/1994 Nohr et al. .
5,334,286 8/1994 Van Phan et al. ..... 162/158
5,336,552 8/1994 Strack et al. ..... 428/224
5,342,534 8/1994 Skrobala et al. ..... 252/91
5,372,739 12/1994 Neal et al. ..... 252/8.6
5,382,400 1/1995 Pike et al. ..... 264/168
5,385,642 1/1995 Van Phan et al. ..... 162/112
5,403,426 4/1995 Johnson et al. ..... 156/256
5,494,731 2/1996 Fereshtehkhou et al. ..... 428/211
5,522,345 6/1996 Warner et al. ..... 424/402
5,525,243 6/1996 Ross ..... 252/8.6
5,527,560 6/1996 Fereshtehkhou et al. ..... 427/288
5,534,340 7/1996 Gupta et al. ..... 428/286
5,540,953 7/1996 Harrington ..... 427/383.5
5,540,979 7/1996 Yahiaoui et al. ..... 428/212
5,540,984 * 7/1996 Quincy, III et al. ..... 428/266
5,545,481 8/1996 Harrington ..... 428/378
5,595,675 1/1997 Aso et al. ..... 252/8.61
5,620,788 4/1997 Garavaglia et al. ..... 442/118
5,624,676 4/1997 Mackey et al. ..... 424/414
5,629,006 5/1997 Hoang et al. ..... 424/405
5,639,450 6/1997 Oldenhove de Guertechin
..... 424/70.19
5,643,498 7/1997 Li et al. ..... 252/357
5,643,588 7/1997 Roe et al. ..... 424/402
5,643,864 7/1997 Li et al. ..... 510/499
5,655,586 8/1997 Li et al. ..... 510/535
5,667,749 9/1997 Lau et al. ..... 264/555
5,677,058 10/1997 Neal et al. ..... 428/375
5,702,377 12/1997 Collier, IV et al. ..... 604/361
5,710,121 1/1998 Tracy et al. ..... 510/467
5,711,994 1/1998 Powers ..... 427/255.6
5,721,048 2/1998 Schmalz ..... 428/369
5,756,112 5/1998 Mackey ..... 424/402
5,759,926 6/1998 Pike et al. ..... 442/333
5,762,948 6/1998 Blackburn et al. ..... 424/404
5,763,334 6/1998 Gupta et al. ..... 442/360
5,783,554 7/1998 Li et al. ..... 510/488

* cited by examiner

NONWOVENS TREATED WITH SURFACTANTS HAVING HIGH POLYDISPERSITIES

FIELD OF THE INVENTION

This invention relates to a nonwoven fabric having wettability that is both rapid and durable. More particularly, the invention relates to a nonwoven fabric treated with a hydrophilic surfactant having a broad molecular weight distribution, characterized by a high polydispersity.

BACKGROUND OF THE INVENTION

Nonwoven fabrics and their manufacture have been the subject of extensive development resulting in a wide variety of materials for numerous applications. For example, nonwovens of light basis weight and open structure are used in personal care items such as disposable diapers as liner fabrics that provide dry skin contact but readily transmit fluids to more absorbent materials which may also be nonwovens of a different composition and/or structure. Nonwovens of heavier weights may be designed with pore structures making them suitable for filtration, absorbent and barrier applications such as wrappers for items to be sterilized, wipers or protective garments for medical, veterinary or industrial uses. Even heavier weight nonwovens have been developed for recreational, agricultural and construction uses. These are but a few of the practically limitless examples of types of nonwovens and their uses that will be known to those skilled in the art who will also recognize that new nonwovens and uses are constantly being identified. There have also been developed different ways and equipment to make nonwovens having desired structures and compositions suitable for these uses. Examples of such processes include spunbonding, meltblowing, carding, and others which will be described in greater detail below. The present invention has general applicability to nonwovens as will be apparent to one skilled in the art, and it is not to be limited by reference or examples relating to specific nonwovens which are merely illustrative.

It is not always possible to efficiently produce a nonwoven having all the desired properties as formed, and it is frequently necessary to treat the nonwoven to improve or alter properties such as wettability by one or more fluids, repellency to one or more fluids, electrostatic characteristics, conductivity, and softness, to name just a few examples. Conventional treatments involve steps such as dipping the nonwoven in a treatment bath, coating or spraying the nonwoven with the treatment composition, and printing the nonwoven with the treatment composition. For cost and other reasons it is usually desired to use the minimum amount of treatment composition that will produce the desired effect with an acceptable degree of uniformity.

When a nonwoven web is formed of a hydrophobic material, for example, a polyolefin, it is often desirable to modify the surface of the nonwoven web using a hydrophilic surfactant to increase the wettability of the web. An external hydrophilic surfactant is typically applied to the surface of the nonwoven web. An internal hydrophilic surfactant is typically blended with the polymer used to form the nonwoven web, and later migrates to the surface after the nonwoven web is formed.

External and internal hydrophilic surfactants may be characterized in terms of their durability and wettability. The durability of a surfactant refers generally to its ability to withstand stresses, such as repeated washing cycles of the nonwoven fabric, without being removed from the fabric or otherwise losing its effectiveness. The wettability of a surfactant refers generally to its ability to transform a hydrophobic nonwoven web into a fabric which readily assimilates and distributes aqueous liquids. Surfactants which cause an otherwise hydrophobic nonwoven web to assimilate liquids at a relatively fast pace, with high fluid intake volumes, are referred to as faster wetting surfactants. Surfactants which cause the nonwoven web to assimilate aqueous liquids at a relatively slow pace, with low fluid intake volume, are referred to as slower wetting surfactants. In addition to the surfactant type, other factors affect the ability of the nonwoven web to assimilate liquids, including without limitation the nonwoven web type, nonwoven polymer type, fiber size and density, amount of surfactant, and how it is applied.

Surfactants having high durability are desirable for a variety of reasons.

However, durable surfactants often provide insufficient wetting, and do not lend themselves to optimization of wetting characteristics desired for individual end use applications. There is a need or desire for a surfactant composition having both durability and a faster rate of wetting. There is also a need or desire for a nonwoven fabric having durable wetting whose rate is relatively fast.

SUMMARY OF THE INVENTION

The present invention is directed to a nonwoven web treated with a hydrophilic organosilicone surfactant having a relatively broad molecular weight distribution, characterized by a polydispersity of at least 2.0. The broad molecular weight distribution surfactant imparts both durability and a fast rate of wetting to the nonwoven fabric. The surfactant may be used either internally or externally.

When the nonwoven web is provided with the broad molecular weight hydrophilic surfactant applied internally, it is believed that the smaller surfactant molecules migrate to the nonwoven filament surfaces somewhat rapidly to provide a fast rate of wetting. Over time, the intermediate molecular weight surfactant molecules migrate to the surface. The higher molecular weight surfactant molecules also migrate to the nonwoven filament surfaces, at an even slower rate. This delayed migration of the intermediate and higher molecular weight surfactant molecules causes the nonwoven fabric to have durable wetting properties.

When the nonwoven web is provided with the broad molecular weight hydrophilic surfactant applied externally, the smaller surfactant molecules may provide faster wetting while the larger molecules, which are more difficult to wash away, provide durable wetting. In either case, the nonwoven fabric has fast and durable wetting resulting from the use of a broad molecular weight hydrophilic surfactant.

DEFINITIONS

Figure 1:
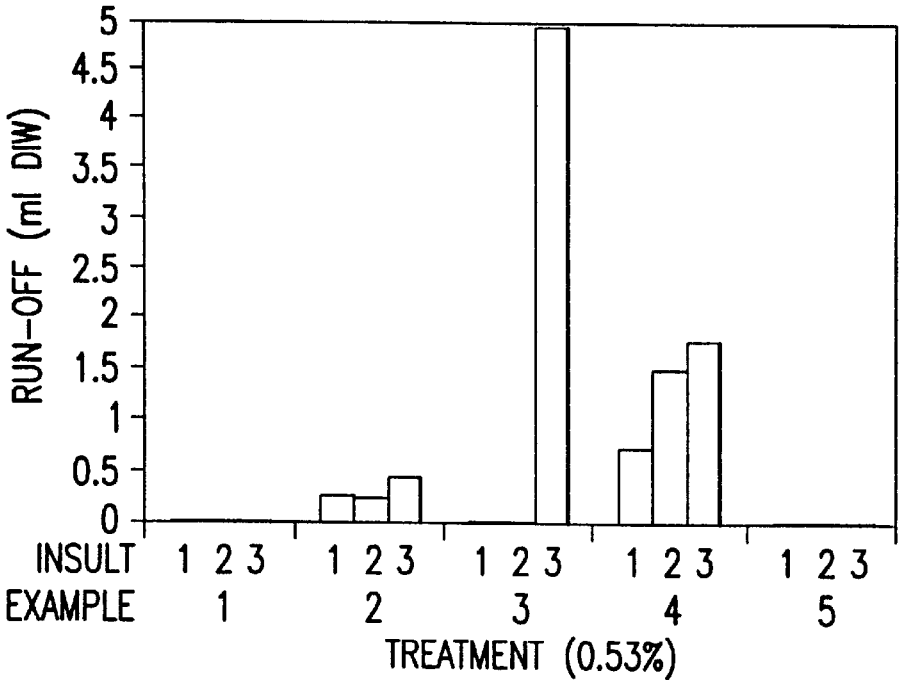
FIGS. 1–5 show run-off test results for various surfactant-treated fabrics described in Examples 1–7.

The term "nonwoven fabric or web" means a web having a structure of individual fibers or threads which are interlaid, but not in a regular or identifiable manner as in a knitted fabric. Nonwoven fabrics or webs have been formed from many processes such as, for example, meltblowing processes, spunbonding processes, air laying processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91.)

The term "microfibers" means small diameter fibers having an average diameter not greater than about 75 microns, for example, having an average diameter of from about 1 micron to about 50 microns, or more particularly, microfibers may have an average diameter of from about 1 micron to about 30 microns. Another frequently used expression of fiber diameter is denier, which is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex," which is defined as the grams per kilometer of fiber. Tex may be calculated as denier/9.

The term "spunbonded fibers" refers to small diameter fibers which are formed by extruding molten thermoplastic material as filaments from a plurality of fine capillaries of a spinnerette having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartnan, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average diameters larger than about 7 microns, more particularly, between about 10 and 30 microns.

The term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface. Meltblown fibers used in the present invention are preferably substantially continuous in length.

The term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g., titanium dioxide for color, are generally present in an amount less than 5 weight percent and more typically about 2 weight percent.

The term "polymer" includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

The term "substantially continuous filaments or fibers" refers to filaments or fibers prepared by extrusion from a spinnerette, including without limitation spunbonded and meltblown fibers, which are not cut from their original length prior to being formed into a nonwoven web or fabric. Substantially continuous filaments or fibers may have average lengths ranging from greater than about 15 cm to more than one meter, and up to or beyond the length of the web or fabric being formed. The definition of "substantially continuous filaments or fibers" includes those which are not cut prior to being formed into a nonwoven web or fabric, but which are later cut when the nonwoven web or fabric is cut.

The term "staple fibers" means fibers which are natural or cut from a manufactured filament prior to forming into a web, and which have an average length ranging from about 0.1–15 cm, more commonly about 0.2–7 cm.

The term "bicomponent filaments or fibers" refers to fibers which have been formed from at least two polymers extruded from separate extruders but spun together to form one fiber. The polymers are arranged in substantially constantly positioned distinct zones across the cross-section of the bicomponent fibers and extend continuously along the length of the bicomponent fibers. The configuration of such a bicomponent fiber may be, for example, a sheath/core arrangement wherein one polymer is surrounded by another or may be a side-by-side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios. Conventional additives, such as pigments and surfactants, may be incorporated into one or both polymer streams, or applied to the filament surfaces.

The term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at Pages 273 through 277.

The term "blend" as applied to polymers, means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

The term "pulp fibers" refers to fibers from natural sources such as woody and non-woody plants. Woody plants include, for example, deciduous and coniferous trees. Non-woody plants include, for instance, cotton, flax, esparto grass, milkweed, straw, jute hemp, and bagasse.

The term "average pulp fiber length" refers to a weighted average length of pulp determined using a Kajaani fiber analyzer Model No. FS-100 available from Kajaani Oy Electronics in Kajaani, Finland. Under the test procedure, a fiber sample is treated with a macerating liquid to ensure that no fiber bundles or shives are present. Each fiber sample is dispersed in hot water and diluted to about a 0.001% concentration. Individual test samples are drawn in approximately 50 to 500 ml portions from the dilute solution and tested using the standard Kajaani fiber analysis procedure. The weighted average fiber lengths may be expressed by the following equation:

$$\sum_{X_i>0}^{k} (X_i * n_i)/n$$

where k=maximum fiber length, $X_i$=individual fiber length, $n_i$=number of fibers having length $X_i$ and n=total number of fibers measured.

The term "superabsorbent material" refers to a water-swellable, water-insoluble organic or inorganic material capable, under the most favorable conditions, of absorbing at least about 20 times its weight, preferably at least about 30 times its weight in an aqueous solution containing 0.9% by weight sodium chloride.

The term "through-air bonding" or "TAB" means a process of bonding a nonwoven, for example, a bicomponent fiber web in which air which is sufficiently hot to melt one of the polymers of which the fibers of the web are made is forced through the web. The air velocity is often between 100 and 500 feet per minute and the dwell time may be as long as 6 seconds. The melting and resolidification of the polymer provides the bonding. Through-air bonding has restricted variability and is generally regarded as a second step bonding process. Since TAB requires the melting of at least one component to accomplish bonding, it is restricted to webs with two components such as bicomponent fiber webs or webs containing an adhesive fiber or powder.

The term "thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern, is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g., like a window screen Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

The term "personal care product" means diapers, training pants, swim wear, absorbent underpants, baby wipes, adult incontinence products, and feminine hygiene products.

The term "hydrophilic" or "wettable" means that the polymeric material has an apparent surface free energy such that the polymeric material is wettable by an aqueous medium, i.e., a liquid medium of which water is a major component. That is, an aqueous medium wets the nonwoven fabric. "Apparent surface free energy" refers to the highest surface tension of an aqueous liquid which wets the polymeric material. For example, the apparent surface free energy of a polymeric material that is wetted by an aqueous liquid having a surface tension of 72 dynes/cm, is at least 72 dynes/cm and possibly higher. In the fabrics of the invention, a surface of the nonwoven fabric has been treated with a surfactant using internal or external application techniques as described below. The wettability of a fabric can be characterized in terms of mutiple-insult durability and time durability, using the run-off test described below, and as further explained in the detailed description of the presently preferred embodiments.

Test Procedure (Run-off Test)

Figure 6:
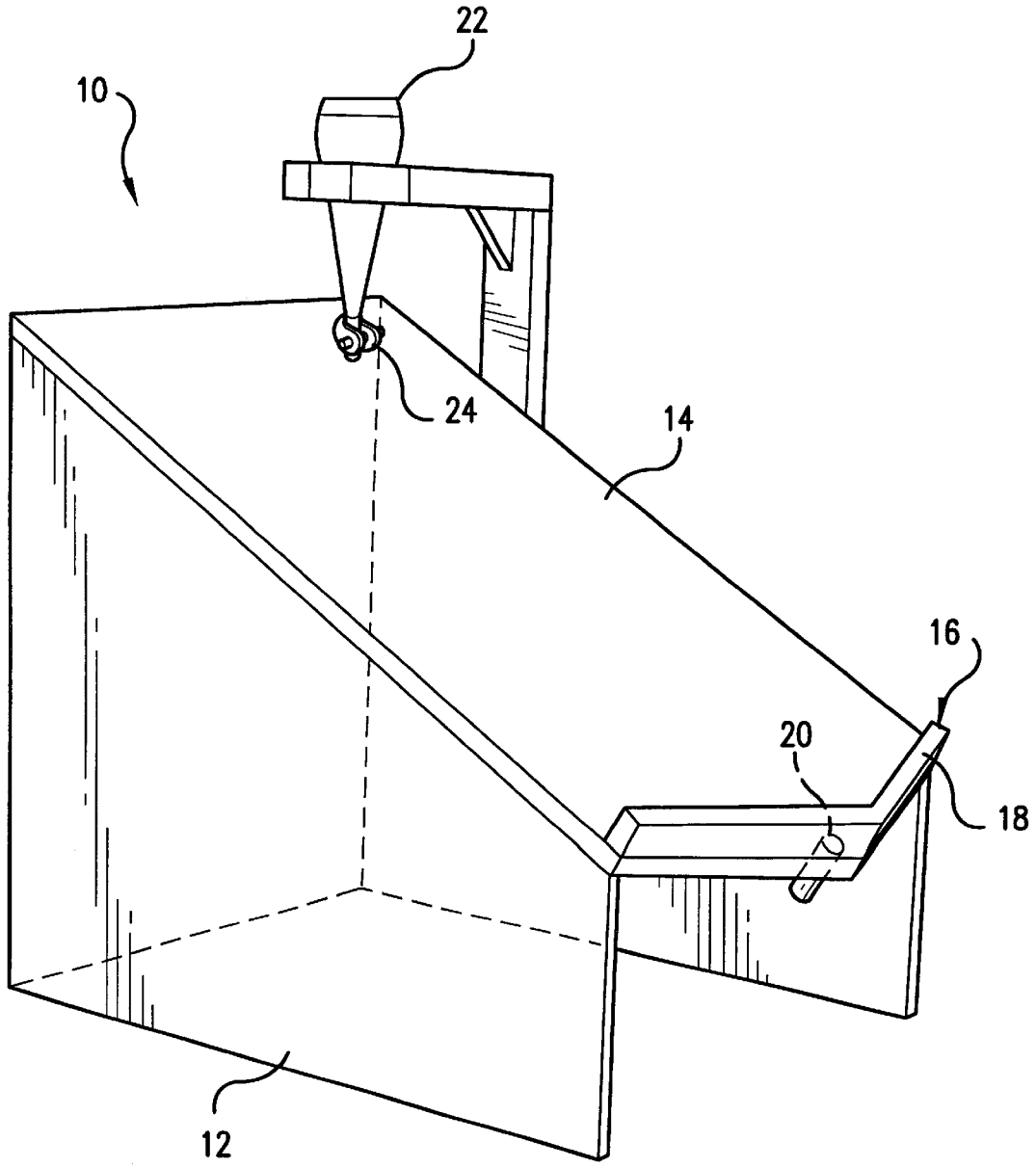
FIG. 6 shows an apparatus used in the run-off test.

The run-off (exposure) test is described in U.S. Pat. No. 5,258,221 to Meirowitz et al., which is incorporated herein in its entirety by reference. FIG. 6 illustrates the prior art apparatus used in performing these run-off determinations. With reference to FIG. 6, an inclined platform 10 is provided. Platform 10 includes a base 12 and an inclined surface 14. The inclined surface 14 has a width of 14 inches and a length along its transverse centerline of 22 inches. The inclined surface shown is inclined at an angle of 30 degrees. In the experiments discussed herein, the angle of the inclined surface was adjusted to 45 degrees except for the modified run-off test described below. Located at a bottom edge 16 of inclined plane 14 are V-shaped barrier means 18. V-shaped barrier means 18 serve to funnel liquid running down inclined surface 14 into a hole located in the center of V-shaped barrier means 18. Suspended above inclined surface 14 is a dispensing funnel 22. Dispensing funnel 22 is adapted to hold 100 milliliters of a liquid, which liquid can be released through valve 24 onto inclined surface 14. In the experiments discussed herein, the liquid was water, except for the modified run-off test discussed below. The height of valve 24 above inclined surface 14 is adjustable to allow for a clearance of 10 millimeters between valve 24 and a sample to be tested when in position on inclined surface 14.

A generally rectangular test sample 8 inches wide (20.32 centimeters) and 15 inches long (38.1 centimeters) is provided. The test sample is mounted on inclined surface 14 with tape at each of its four corners. The test sample is generally centered on inclined surface 14 and the funnel 22 located approximately 7.8 inches (200 millimeters) from the bottom (lowest edge) of the test sample and transversely centered on said sample. The valve 24 is located approximately 10 millimeters above the top surface of the test sample. One hundred milliliters of water is placed in funnel 22. The water has a temperature of 35° C. A collection device is placed under hole 20. Valve 24 is opened to dispense the 100 milliliters of water contained in funnel 22 over a period of about 15 seconds. The amount of water which runs off and is collected in the collection means is determined and recorded. Typically, the absorbent material is changed between insults, and the nonwoven web is dried.

Figure 4:
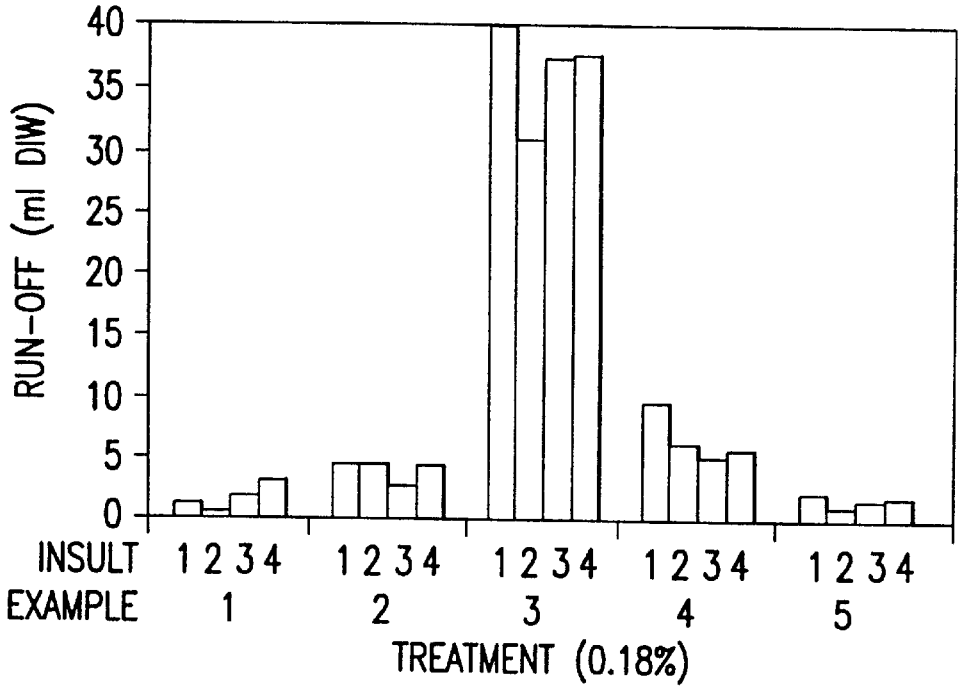

A modified version of the run-off test is discussed below with respect to Examples 1–5 and the results shown in FIG. 4. In the modified run-off test, the nonwoven material is insulted with 60 ml of an aqueous 0.85% saline solution (pH 7.0–7.2, 37° C.) on a 30-degree inclined plane. Any solution which does not penetrate the nonwoven material within one inch of the liquid strike area is collected as run-off. This is accomplished by placing a polyethylene film over the nonwoven web, to cover the web on the lower portion of the inclined plane up to one inch away from the liquid strike area. The nonwoven web is not dried between repeated insults, although the absorbent layer is changed after each insult. The modified run-off test measures the ability of the nonwoven fabric to transport fluid to the absorbent material.

Test Procedure (Polydispersity)

The polydispersity of a polymer is the ratio of weight average molecular weight ($M_W$) to number average molecular weight ($M_N$). The molecular weights can be determined using Gel Permeation Chromotography (GPC), using a standard operating procedure for a GPC column. In the GPC method, tetrahydrofuran (THF) can be used as the mobile phase. The polymer (in this case, polymer surfactant) can be dissolved in the THF in amounts of 100 mg surfactant per 20 ml of THF at 30° C. One hundred ml of the resulting solution can be injected into a Shodex Three Linear GPC column. The molecular weights ($M_W$ and $M_N$, as well as the "z" average molecular weight and overall molecular weight distribution) can be assigned by comparing the elution time of the surfactant with a calibration plot. The calibration plot can, for instance, show elution times for a series of polyethylene glycols of known molecular weight.

DETAILED DESCRIPTION OF THE PRESENTLY PREFERRED EMBODIMENTS

The fabric of the invention is a nonwoven web including a plurality of filaments made from one or more polymers, and treated with a hydrophilic surfactant having a broad molecular weight distribution. The nonwoven web may be a spunbond web, a meltblown web, a bonded carded web, or another type of nonwoven web, and may be present in a single layer or a multilayer composite including one or more nonwoven web layers.

A wide variety of thermoplastic polymers may be used to construct the nonwoven web, including without limitation polyamides, polyesters, polyolefins, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, poly-1-butene, copolymers of poly-1-butene including ethylene-1-butene copolymers, polybutadiene, isobutylene-isoprene copolymers, and combinations of any of the foregoing. Polyolefins are preferred. Polyethylene and polypropylene homopolymers and copolymers are most preferred. The webs may also be constructed of bicomponent or biconstituent filaments or fibers, as defined above. The nonwoven webs may have a wide variety of basis weights, preferably ranging from about 0.1 gram per square meter (gsm) to about 100 gsm. Most of these materials are hydrophobic, and are rendered hydrophilic (wettable) by the surfactant. The surfactant may also be used with hydrophilic base materials, to enhance their wettability.

The hydrophilic surfactant has a relatively broad molecular weight distribution, characterized by a polydispersity of at least about 2.0, preferably at least about 2.5, more preferably at least about 3.5, most preferably at least about 4.5. The term "polydispersity" refers to the ratio of weight average molecular weight ($M_W$) divided by number average molecular weight ($M_N$).

The hydrophilic surfactant applied to the nonwoven web should have sufficiently fast initial wetting to render the fabric useful in applications requiring a wettable surface. The rate of wetting can be determined using the run-off test procedure described above at least about 1 day after the surfactant-treated fabric is prepared. A fabric generally has sufficiently fast initial wetting if a first insult of 100 ml deionized water applied to the fabric using the run-off test procedure, results in run-off of not more than about 3 ml, preferably not more than about 1.5 ml.

The hydrophilic surfactant applied to the nonwoven web should have multiple insult-durable fast wetting properties. This can also be determined using the run-off test procedure. A fabric generally has multiple insult-durable wetting if first, second and third insults of 100 ml deionized water applied to the fabric using the run-off test procedure, result in run-off of not more than about 3 ml for each of the insults, preferably not more than about 1.5 ml for each of the insults. Samples are typically dried using ambient air between insults.

The hydrophilic surfactant applied to the nonwoven web should also have time-durable fast wetting properties. A fabric generally has time-durable fast wetting if first, second and third insults of 100 ml deionized water, applied at least about one week after the surfactant-treated fabric preparation, each result in run-offs of not more than about 3 ml, preferably not more than about 1.5 ml. Again, the samples are dried between insults.

The hydrophilic surfactant applied to the nonwoven web should have extended time-durable fast wetting properties. A fabric generally has extended time-durable fast wetting if first, second and third insults of 60 ml deionized water applied at least about four weeks after preparation of the surfactant-treated fabric, each result in run-offs of not more than about 3 ml. Again, the samples are dried between insults.

Presently preferred surfactants include without limitation organosilicone-based surfactants having the polydispersities described above. Examples of suitable organosilicone surfactants include silicone phosphate polyethers, fluorosilicone surfactants, and other organosilicone polymers having the recited polydispersities. Suitable surfactants include without limitation MFF 184 SW, a silicone polyether surfactant available from Lambent Technologies, located in Norcross, Ga., which has a polydispersity of about 4.71 (based on an $M_W$ of 4175 and an $M_N$ of 885). Another suitable commercially available surfactant is Lambent Phos® A-200, a silicone phosphate polyether surfactant available from Lambent Technologies, which has a polydispersity of about 2.21 (based on an $M_W$ of 5160 and an $M_N$ of 2335). Another silicone phosphate polyether surfactant is SW-P-30, available from Lambent Technologies, which has a polydispersity of about 2.43 (based on an $M_W$ of 2550 and an $M_N$ of 1050). Another suitable surfactant is Lambent Wax® WD-F, a fluorinated silicone surfactant available from Lambent Technologies, which has a polydispersity of about 5.40 (based on an $M_W$ of 6750 and an $M_N$ of 1250).

It is important to note that, while many organosilicone surfactants are known, most of them have narrower molecular weight distributions than those used in the invention. U.S. Pat. No. 4,857,271, issued to Nohr, discloses silicone polyethers and other surfactants and states that most have polydispersities of about 1.2 or less. MASIL® SF-19, an ethoxylated trisiloxane surfactant available from PPG Industries, has a polydispersity of about 1.4 (based on an $M_W$ of about 915 and an $M_N$ of about 655).

While the main focus of the invention is on individual surfactants having high polydispersities, it is also within the scope of the invention to achieve the same aggregate high polydispersities by combining two or more surfactants having different molecular weight ranges. For instance, a generally higher molecular weight surfactant may be combined with a generally lower molecular weight surfactant to create a combined surfactant having a broad or bimodal molecular weight distribution. One blended surfactant is AHCOVEL® Base N-62, which contains sorbitan monooleate and hydrogenated castor oil. AHCOVEL® Base N-62 has a polydispersity of about 2.14 (based on an $M_W$ of 2250 and an $M_N$ of 1050), and is made by Hodgson Textile Chemicals in Mount Holly, N.C.

The high polydispersity hydrophilic surfactant may be applied using internal or external application techniques known in the art. Some surfactants operate more favorably when applied internally and are known as "internal surfactants." Others operate more favorably when applied externally and are known as "external surfactants" or "topical surfactants." Still other surfactants operate suitably as both internal and external surfactants.

As is generally known, an internal surfactant is typically blended with the polymer used to make the nonwoven web, and migrates to the surfaces of the nonwoven web filaments during and/or after the formation of the filaments. Often, the migration results from a stimulus, such as heat applied to the filaments. An external surfactant is one which is applied externally to the surfaces of the nonwoven web filaments after they are formed. An external surfactant may be applied by dipping, soaking, spraying, or otherwise coating the nonwoven web with a solvent or other medium containing the surfactant.

The amount of surfactant needed to provide durable, sufficiently fast wetting may vary depending on the surfactant type, its polydispersity, the base polymer type, and whether the surfactant is added internally or externally. On a solvent-free weight basis, the hydrophilic surfactant should generally constitute about 0.05–10% by weight of the nonwoven fabric to which it is applied, preferably about 0.1–3% by weight, more preferably about 0.2–2% by weight. Very high surfactant levels are more easily washed away and provide little added wettability, while very low levels may not impart sufficient wettability to the nonwoven fabric.

The treated nonwoven fabrics thus formed have wettability which is both durable and sufficiently fast. The treated nonwoven fabric can be used in a wide variety of absorbent product applications including, in particular, personal care absorbent products. Personal care absorbent products include diapers, training pants, swim wear, absorbent underpants, baby wipes, adult incontinence products, feminine hygiene products, and the like. In most absorbent products, the treated nonwoven fabric is used as a cover sheet or containment matrix for an absorbent medium. An absorbent medium may include, for instance, pulp fibers alone or in combination with a superabsorbent material. The treated nonwoven fabric can also be used in medical absorbent products, including without limitation underpads, absorbent drapes bandages, and medical wipes.

The pulp fibers may be any high-average fiber length pulp, low-average fiber length pulp, or mixtures of the same. Preferred pulp fibers include cellulose fibers. The term "high average fiber length pulp" refers to pulp that contains a relatively small amount of short fibers and non-fiber particles. High fiber length pulps typically have an average fiber length greater than about 1.5 mm, preferably about 1.5–6 mm, as determined by an optical fiber analyzer, such as the Kajaani tester referenced above. Sources generally include non-secondary (virgin) fibers as well as secondary fiber pulp which has been screened. Examples of high average fiber length pulps include bleached and unbleached virgin softwood fiber pulps.

The term "low average fiber length pulp" refers to pulp that contains a significant amount of short fibers and non-fiber particles. Low average fiber length pulps have an average fiber length less than about 1.5 mm, preferably about 0.7–1.2 mm, as determined by an optical fiber analyzer such as the Kajaani tester referenced above. Examples of low fiber length pulps include virgin hardwood pulp, as well as secondary fiber pulp from sources such as office waste, newsprint, and paperboard scrap.

Examples of high average fiber length wood pulps include those available from the U.S. Alliance Coosa Pines Corporation under the trade designations Longlac 19, Coosa River 56, and Coosa River 57. The low average fiber length pulps may include certain virgin hardwood pulp and secondary (i.e., recycled) fiber pulp from sources including newsprint, reclaimed paperboard, and office waste. Mixtures of high average fiber length and low average fiber length pulps may contain a predominance of low average fiber length pulps. For example, mixtures may contain more than about 50% by weight low-average fiber length pulp and less than about 50% by weight high-average fiber length pulp.

The term "superabsorbent" or "superabsorbent material" refers to a water swellable, water-insoluble organic or inorganic material capable, under the most favorable conditions, of absorbing at least about 20 times its weight and, more desirably, at least about 30 times its weight in an aqueous solution containing 0.9 weight percent sodium chloride.

The superabsorbent materials can be natural, synthetic and modified natural polymers and materials. In addition, the superabsorbent materials can be inorganic materials, such as silica gels, or organic compounds such as cross-linked polymers. The term "cross-linked" refers to any means for effectively rendering normally water-soluble materials substantially water insoluble but swellable. Such means can include, for example, physical entanglement, crystalline domains, covalent bonds, ionic complexes and associations, hydrophilic associations, such as hydrogen bonding, and hydrophobic associations or Van der Waals forces.

Examples of synthetic superabsorbent material polymers include the alkali metal and ammonium salts of poly(acrylic acid) and poly(methacrylic acid), poly(acrylamides), polyvinyl ethers), maleic anhydride copolymers with vinyl ethers and alpha-olefins, poly(vinyl pyrrolidone), poly (vinylmorpholinone), poly(vinyl alcohol), and mixtures and copolymers thereof. Further superabsorbent materials include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and the like. Mixtures of natural and wholly or partially synthetic superabsorbent polymers can also be useful in the present invention. Other suitable absorbent gelling materials are disclosed by Assarsson et al. in U.S. Pat. No. 3,901,236 issued Aug. 26, 1975. Processes for preparing synthetic absorbent gelling polymers are disclosed in U.S. Pat. No. 4,076,663 issued Feb. 28, 1978 to Masuda et al. and U.S. Pat. No. 4,286,082 issued Aug. 25, 1981 to Tsubakimoto et al.

Superabsorbent materials may be xerogels which form hydrogels when wetted. The term "hydrogel," however, has commonly been used to also refer to both the wetted and unwetted forms of the superabsorbent polymer material. The superabsorbent materials can be in many forms such as flakes, powders, particulates, fibers, continuous fibers, networks, solution spun filaments and webs. The particles can be of any desired shape, for example, spiral or semi-spiral, cubic, rod-like, polyhedral, etc. Needles, flakes, fibers, and combinations may also be used.

Superabsorbents are generally available in particle sizes ranging from about 20 to about 1000 microns. Examples of commercially available particulate superabsorbents include SANWET® IM 3900 and SANWET® IM-5000P, available: from Hoescht Celanese located in Portsmouth, Va., DRYTECH® 2035LD available from Dow Chemical Co. located in Midland, Mich., and FAVOR® SXM880, available from Stockhausen, located in Greensboro, N.C. An example of a fibrous superabsorbent is OASIS® 101, available from Technical Absorbents, located in Grimsby, United Kingdom.

As indicated above, the nonwoven fabric may be a cover sheet or a matrix for an absorbent medium. When employed as a matrix, the filaments may be combined with pulp fibers and (optionally) a superabsorbent material using processes well known in the art. For example, a coform process may be employed, in which at least one meltblown diehead is arranged near a chute through which other materials are added while the web is forming. Coform processes are described in U.S. Pat. No. 4,818,464 to Lau and U.S. Pat. No. 4,100,324 to Anderson et al., the disclosures of which are incorporated by reference. The substantially continuous bicomponent filaments and pulp fibers may also be combined using hydraulic entangling or mechanical entangling. A hydraulic entangling process is described in U.S. Pat. No. 3,485,706 to Evans, the disclosure of which is incorporated by reference.

When the treated thermoplastic nonwoven filaments are used as a matrix for an absorbent nonwoven web composite, the composite should contain about 5–97% by weight pulp fibers, preferably about 35–95% by weight pulp fibers, more preferably about 50–95% by weight pulp fibers. When a superabsorbent material is present, it should constitute about 5–90% by weight of the composite, preferably about 10–60% by weight, more preferably about 20–50% by weight. In either case, the thermoplastic nonwoven filament matrix should constitute about 3–95% by weight of the composite, preferably about 5–65% by weight, more preferably about 5–50% by weight.

After combining the ingredients together, the absorbent nonwoven composites may be bonded together using the thermal point bonding or through-air bonding techniques described above, to provide a coherent high integrity structure.

EXAMPLES 1–5

A standard diaper liner fabric, made of polypropylene spunbonded web having a basis weight of 0.5 ounces/yd$^2$, was topically (externally) treated with the surfactants listed below using a conventional dip and nip process. The solvent for the surfactant bath was water. The fabric samples were treated with two different add-on levels (about 0.18% by weight and about 0.53% by weight) of each of the following surfactants. To achieve the 0.18% level, the surfactant bath contained 0.13% by weight surfactant in water, and 0.5% hexanol. To achieve the 0.53% level, the surfactant bath contained 0.40% by weight surfactant in water, and 0.5% hexanol.

Example 1

Lambent Wax® WD-F, a fluorinated silicone surfactant having a polydispersity of 5.40.

Example 2

AHCOVEL® BASE N-62, a blended surfactant containing sorbitan monooleate and hydrogenated castor oil, having a polydispersity of 2.14.

Example 3

MASIL® SF-19, a control ethoxylated trisiloxane surfactant having a polydispersity of 1.40.

Example 4

Lambent® SW-P-30, a silicone phosphate polyether surfactant having a polydispersity of 2.43.

Example 5

Lambent Phos® A-200, a silicone phosphate polyether surfactant having a polydispersity of 2.21.

In each case, the add-on level was determined as follows, based on the amount of surfactant in the treatment bath and the amount of treatment solution applied to the fabric:

$$\text{Add-on level (\%)} = [\text{wet pick-up of solution}] \times [\text{weight \% surfactant in solution}] = \left[\frac{\text{wet fabric weight minus dry fabric weight}}{\text{dry fabric weight}}\right] \times [\text{weight \% surfactant in solution}]$$

Five samples of each treated fabric were tested using the run-off test described above, within one day of the treated fabric preparation, and the results were averaged. For this testing, 100 ml of deionized water (DIW) at 37° C. was applied to the samples. The average results for each treated fabric are plotted in FIG. 1 (for the 0.53% treatment level) and FIG. 2 (for the 0.18% treatment level). As shown in the Figures, each fabric sample was tested using three liquid insults, and the samples were dried between insults.

Referring to FIG. 1, all five surfactants exhibited initial fast wetting (i.e., less than 3 ml run-off after the first insult) at the 0.53% treatment level. All surfactants except MASIL® SF-19 (low polydispersity organosilicone) exhibited multiple insult-durable fast wetting (not more than 3 ml run-off for each of the first three insults). This shows that higher polydispersity organosilicones (Examples 1, 4 and 5) have better durability than a lower polydispersity organosilicone (Example 3), but roughly the same durability as the blend of two materials, sorbitan monooleate and hydrogenated castor oil (Example 2).

Figure 2:
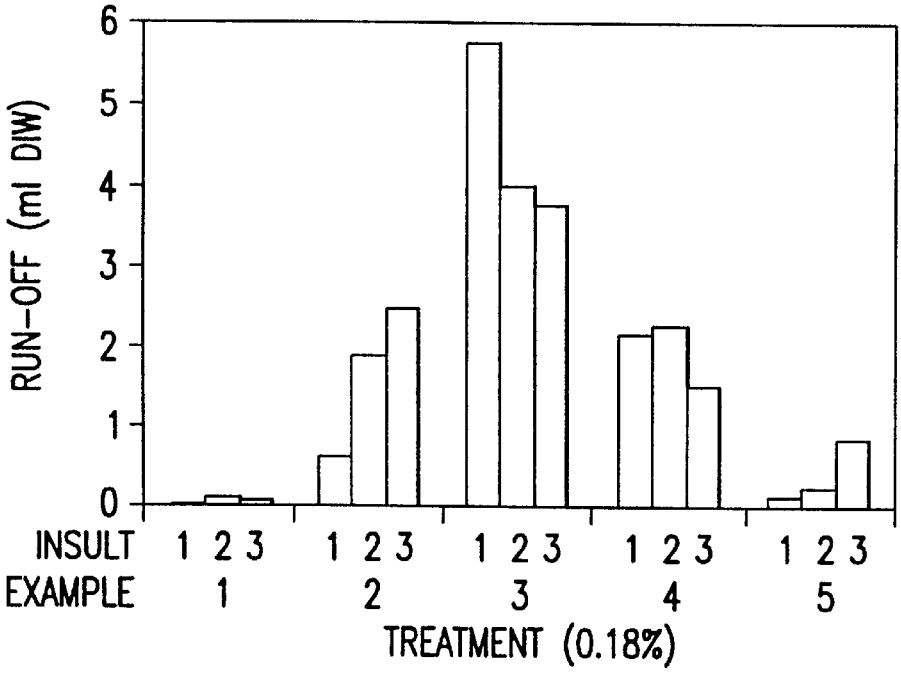

Referring to FIG. 2, essentially the same relationships occurred for the same five surfactants when applied at the lower level of 0.18%. However, the MASIL® SF-19 (Example 3) did not result in initial fast wetting when applied at that level.

Figure 3:
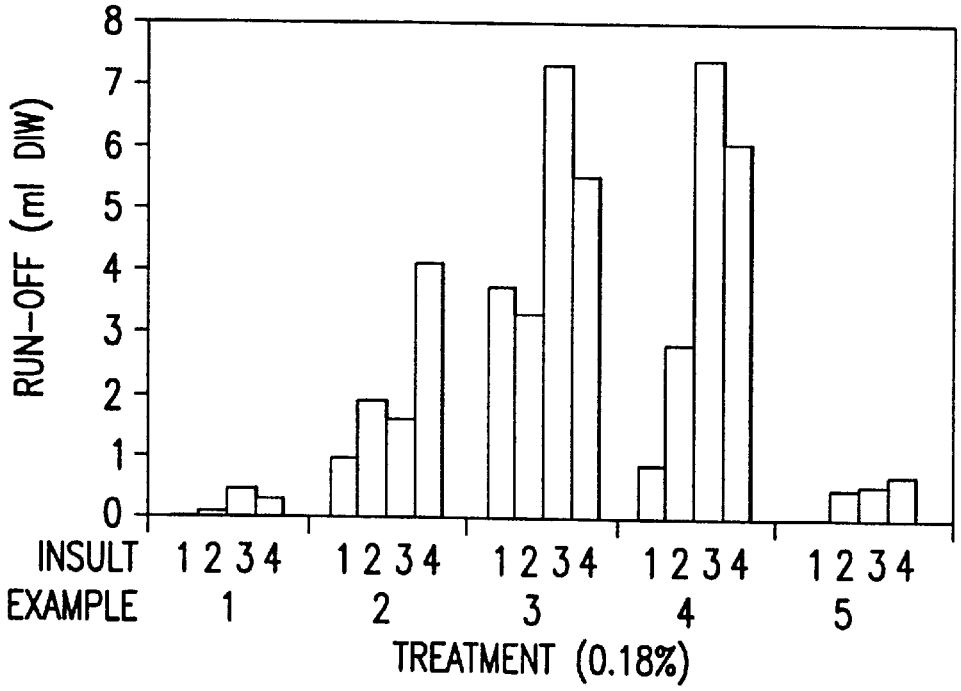

Fabric samples treated with the same five surfactants were tested for time-durable fast wetting by performing the run-off test (100 ml deionized water, 37° C.) about one week after the treated fabrics were prepared. The results are plotted in FIG. 3. All of the surfactants except MASIL® SF-19 (Example 3) exhibited fast wetting after the first fluid insult, defined as run-off not exceeding 3 ml. However, the highest polydispersity organosilicone surfactant (Example 1) showed the best multiple-insult durability, exhibiting less than 0.5 ml run-off for each of the four wash cycles. The organosilicone surfactant of Example 5 exhibited less than 1.0 ml run-off for each of the four wash cycles. The surfactant blend (Example 2) showed multiple-insult durability for the first three wash cycles.

Fabric samples treated with the same five surfactants were tested for extended time-durable fast wetting by performing the modified run-off test described above (60 ml aqueous 0.9% saline solution, 7.0–7.2 pH, 37° C.) about four weeks after the treated fabrics were prepared. The results are plotted in FIG. 4. Only the organosilicone surfactants of Examples 1 and 5 resulted in extended time-durable fast wetting, defined as initial run-off not exceeding 3 ml after four weeks of aging. The two surfactants also exhibited multiple insult-durable wetting after three fluid insults, and even after four fluid insults. Generally, surfactants having broader molecular weight distributions outperformed those having narrower molecular weight distributions.

EXAMPLES 6 AND 7

In order to isolate the effect of polydispersity, samples of the same standard diaper liner nonwoven fabric were internally treated with two chemically similar surfactants having high and low polydispersities, by adding each surfactant into the respective polymer melt used to make the nonwoven fabric.

Example 6

MASIL® SF-19, a silicone polyether surfactant having a polydispersity of 1.40.

Example 7

MFF 184SW, a silicone polyether surfactant having a polydispersity of 4.71.

Figure 5:
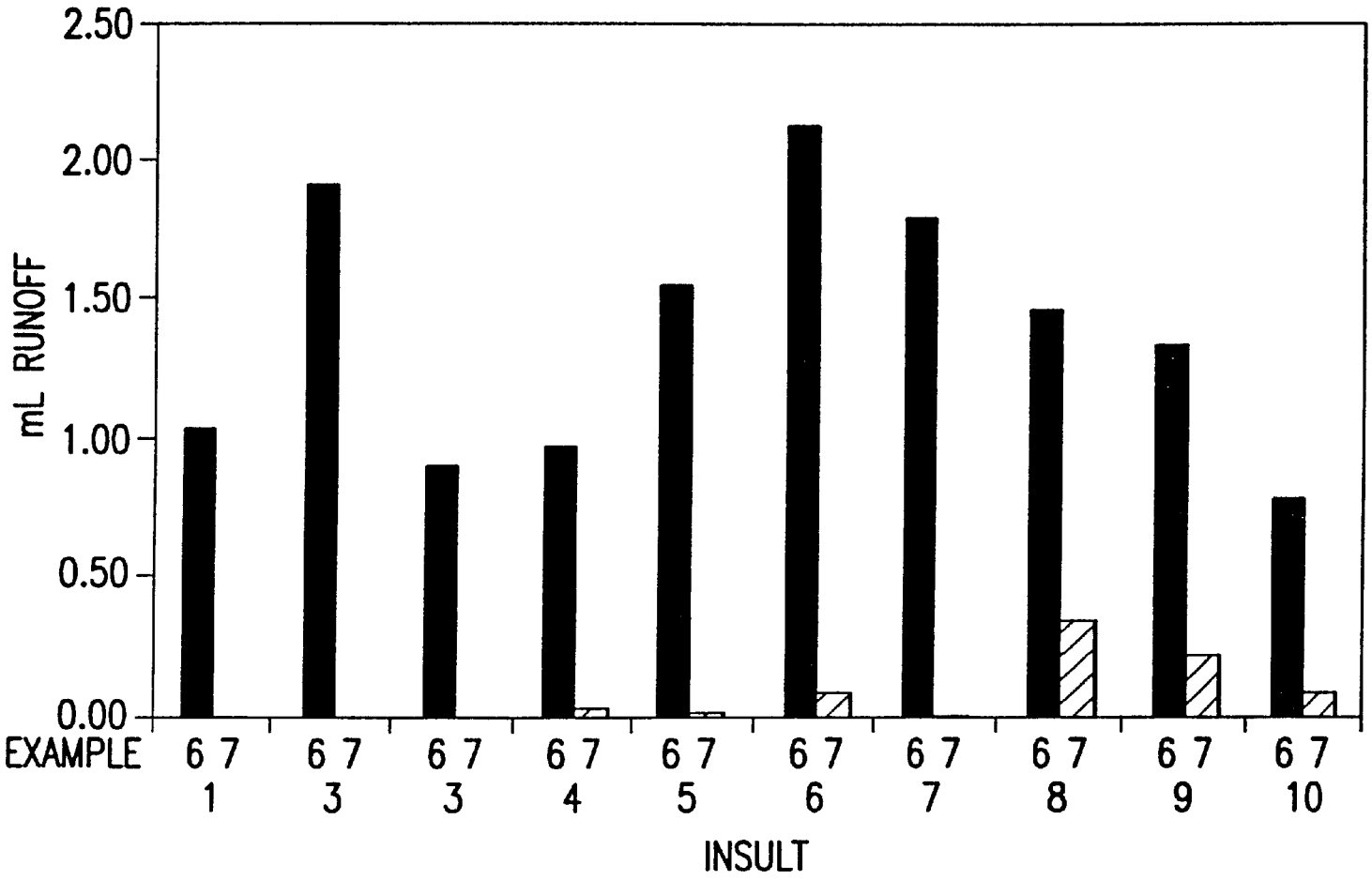

The fabrics were treated at a level of 1.5% surfactant to facilitate testing with multiple fluid insults. About 4–7 days after the treated fabric preparation, samples of each material were evaluated using the standard run-off test (100 ml deionized water, 37° C.) for ten insults. The results are plotted in FIG. 5. Referring to FIG. 5, the higher polydispersity surfactant (Example 7) showed dramatically better wetting than the control (Example 6) after each of the ten insults.

While the embodiments of the invention described herein are presently preferred, various modifications and improvements can be made without departing from the spirit and scope of the invention. The scope of the invention is indicated by the appended claims, and all changes that fall within the meaning and range of equivalents are intended to be embraced therein.

We claim:

1. A treated nonwoven fabric comprising a nonwoven web treated with a hydrophilic organosilicone surfactant;

the hydrophilic organosilicone surfactant having a polydispersity of at least about 3.5;

the treated nonwoven fabric having multiple insult-durable fast wetting properties at least about one day following preparation of the treated fabric.

2. The treated nonwoven fabric of claim 1, wherein the hydrophilic organosilicone surfactant has a polydispersity of at least about 4.5.

3. The treated nonwoven fabric of claim 1, wherein the multiple insult-durable fast wetting properties are retained for at least about one week after the treated fabric is prepared.

4. The treated nonwoven fabric of claim 1, having extended time-durable fast wetting properties.

5. The treated nonwoven fabric of claim 1, wherein the organosilicone comprises a silicone polyether.

6. The treated nonwoven fabric of claim 1, wherein the organosilicone comprises a fluorosilicone surfactant.

7. The treated nonwoven fabric of claim 1, wherein the surfactant is applied externally.

8. The treated nonwoven fabric of claim 1, wherein the surfactant is applied internally.

9. The treated nonwoven fabric of claim 1, comprising about 0.05–10% by weight of the surfactant.

10. The treated nonwoven fabric of claim 1, comprising about 0.1–3% by weight of the surfactant.

11. The treated nonwoven fabric of claim 1, comprising about 0.2–2% by weight of the surfactant.

12. The treated nonwoven fabric of claim 1, wherein the nonwoven web comprises a material selected from the group consisting of polyamides, polyolefins, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, polybutadiene, isobutylene-isoprene copolymers, and combinations of any of the foregoing.

13. The treated nonwoven fabric of claim 1, wherein the nonwoven fabric comprises a polyolefin.

14. The treated nonwoven fabric of claim 1, wherein the nonwoven fabric comprises a polyethylene homopolymer or copolymer.

15. The treated nonwoven fabric of claim 1, wherein the nonwoven fabric comprises a polypropylene homopolymer or copolymer.

16. A treated nonwoven fabric comprising a nonwoven web treated with a hydrophilic surfactant, the hydrophilic surfactant having a polydispersity of at least about 3.5;

the treated nonwoven fabric having extended time-durable fast wetting properties defined as a run-off not exceeding about 3 ml of deionized water following each of three 60 ml aqueous 0.9% saline solution insults applied about four weeks after the treated nonwoven fabric is prepared.

17. The treated nonwoven fabric of claim 16, wherein the surfactant comprises an organosilicone compound.

18. The treated nonwoven fabric of claim 16, wherein the nonwoven web comprises a material selected from the group consisting of polyamides, polyolefins, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, polybutadiene, isobutylene-isoprene copolymers, and combinations of any of the foregoing.

19. The treated nonwoven fabric of claim 16, wherein the nonwoven fabric comprises a polyolefin.

20. The treated nonwoven fabric of claim 16, wherein the nonwoven fabric comprises a polyethylene homopolymer or copolymer.

21. The treated nonwoven fabric of claim 16, wherein the nonwoven fabric comprises a polypropylene homopolymer or copolymer.

22. An absorbent nonwoven composite, comprising:

a nonwoven web treated with a hydrophilic organosilicone surfactant having a polydispersity of at least about 3.5 to form a treated nonwoven fabric having multiple insult-durable fast wetting properties; and an absorbent medium.

23. The absorbent nonwoven composite of claim 22, wherein the absorbent medium is contained within the treated nonwoven fabric.

24. The absorbent nonwoven composite of claim 22, wherein the treated nonwoven fabric serves as a cover material for the absorbent medium.

25. The absorbent nonwoven composite of claim 22, wherein the absorbent medium comprises pulp fibers.

26. The absorbent nonwoven composite of claim 25, wherein the absorbent medium further comprises a superabsorbent material.

27. The absorbent nonwoven composite of claim 22, wherein the as a polydispersity of at least about 4.5.

* * * * *